US006240812B1

(12) United States Patent
Baker

(10) Patent No.: US 6,240,812 B1
(45) Date of Patent: Jun. 5, 2001

(54) TRIPLE DRIVE OPEN-END WRENCH

(75) Inventor: David R. Baker, Fort Worth, TX (US)

(73) Assignee: David Baker Inc., Fort Worth, TX (US)

( * ) Notice: Subject to any disclaimer, the term of this patent is extended or adjusted under 35 U.S.C. 154(b) by 0 days.

(21) Appl. No.: 09/176,120

(22) Filed: Oct. 21, 1998

Related U.S. Application Data

(60) Provisional application No. 60/062,619, filed on Oct. 22, 1997.

(51) Int. Cl.[7] ..... B25B 13/02
(52) U.S. Cl. ..... 81/119; 81/124.3; 81/186
(58) Field of Search ..... 81/119, 124.3, 81/124.7, 186

(56) References Cited

U.S. PATENT DOCUMENTS 4,889,020 12/1989 Baker .
5,074,171 * 12/1991 Annis et al. ..... 81/119
5,117,714 * 6/1992 Pagac et al. ..... 81/119
5,239,899 8/1993 Baker .
5,381,710 1/1995 Baker .

* cited by examiner

*Primary Examiner*—David A. Scherbel
*Assistant Examiner*—Anthony Ojini
(74) *Attorney, Agent, or Firm*—James E. Bradley; Bracewell & Patterson, L.L.P.

(57) ABSTRACT

A wrench for use in driving a hexagonal nut having a wrench head. The wrench head has upper and lower jaws rigidly joined together. The jaws have several faces that allow the wrench to engage the nut from three different positions. The faces are configured to prevent corner contact with the nut so as to resist rounding the corners off. Further, one drive position is configured to lock the wrench to the nut as torque is being applied.

8 Claims, 3 Drawing Sheets

TRIPLE DRIVE OPEN-END WRENCH

This application claims the benefit of U.S. Provisional Application 60/062,619, filed Oct. 22, 1997.

This application is filed simultaneously with a patent application titled "Double Drive Open-End Wrench" by David R. Baker.

FIELD OF THE INVENTION

This invention relates in general to wrenches, and in particular to an open end wrench that provides three surfaces upon which to drive a nut.

DESCRIPTION OF THE PRIOR ART

In a conventional open end wrench, a rigid jaw having flat parallel faces slides over a nut and attempts to engage fully, the flat parallel nut sides. However, because typical hexagonal nuts are built within manufacturing tolerances, a practical wrench must be designed to accommodate variations in the spacing of parallel sides that may be encountered within a nominal nut size. This necessitates clearances between the parallel sides of the nut and the parallel faces of the wrench. These clearances cause the flat parallel faces to engage primarily the nut corners rather than the whole side and may cause the nut corners to become rounded off if torque is applied to the nut with less than perfect wrench to nut contact. This problem is exacerbated when the user cannot or does not slide the wrench completely over the nut and drives the nut with the tips of the wrench jaw. A nut whose corners have been rounded off cannot be driven by a conventional wrench. Further, many times it may be desirable to drive the nut with the wrench tips or while not fully seated in the wrench to save the time of having to seat the wrench fully for each stroke or because space does not allow the wrench to seat fully on the nut.

A number of patents have dealt with the tendency of a conventional wrench to engage the corners of a nut by using arcuate surfaces in lieu of flat parallel surfaces. The arcuate surfaces curve away from the nut corners and engage the nut closer to nut side center. Unfortunately, however, in the same way the arcuate surfaces protect the nut corners, they prevent driving of the nut with the wrench tips or while not fully seated in the wrench. The arcuate surfaces curve away from the nut at the wrench tips, and thus, the wrench tips cannot engage the nut. When the nut is driven while not fully seated, the wrench engages the nut corners and, like the flat parallel faces, can cause the nut corners to become rounded off. Also, some wrenches with arcuate drive surfaces require the wrench head to be larger than a conventional wrench head to withstand the stresses involved in driving a nut. The larger head requires a larger and generally more expensive blank from which to make the wrench. Furthermore, the larger head cannot fit in as small of a space as that of a conventional wrench.

SUMMARY OF THE INVENTION

A wrench of in accordance with this invention has a fixed head comprising an upper jaw and a lower jaw. The upper jaw has an upper forward drive face, an upper intermediate drive face, and an upper rearward drive face. The upper forward, intermediate, and rearward drive faces generally face the lower jaw. The upper forward and upper intermediate drive faces are separated by an upper forward notch. The upper intermediate and upper rearward drive faces are separated by an upper rearward notch. The lower jaw is substantially a mirror image of the upper jaw having a lower forward drive face, lower intermediate drive face, and lower rearward drive face separated by notches. A back stop face joins the upper and rearward drive faces. The forward, intermediate, and rearward drive faces are adapted to allow the wrench to drive a nut in three different positions in plane to plane contact.

DETAILED DESCRIPTION OF THE PREFERRED EMBODIMENT

Figure 1:
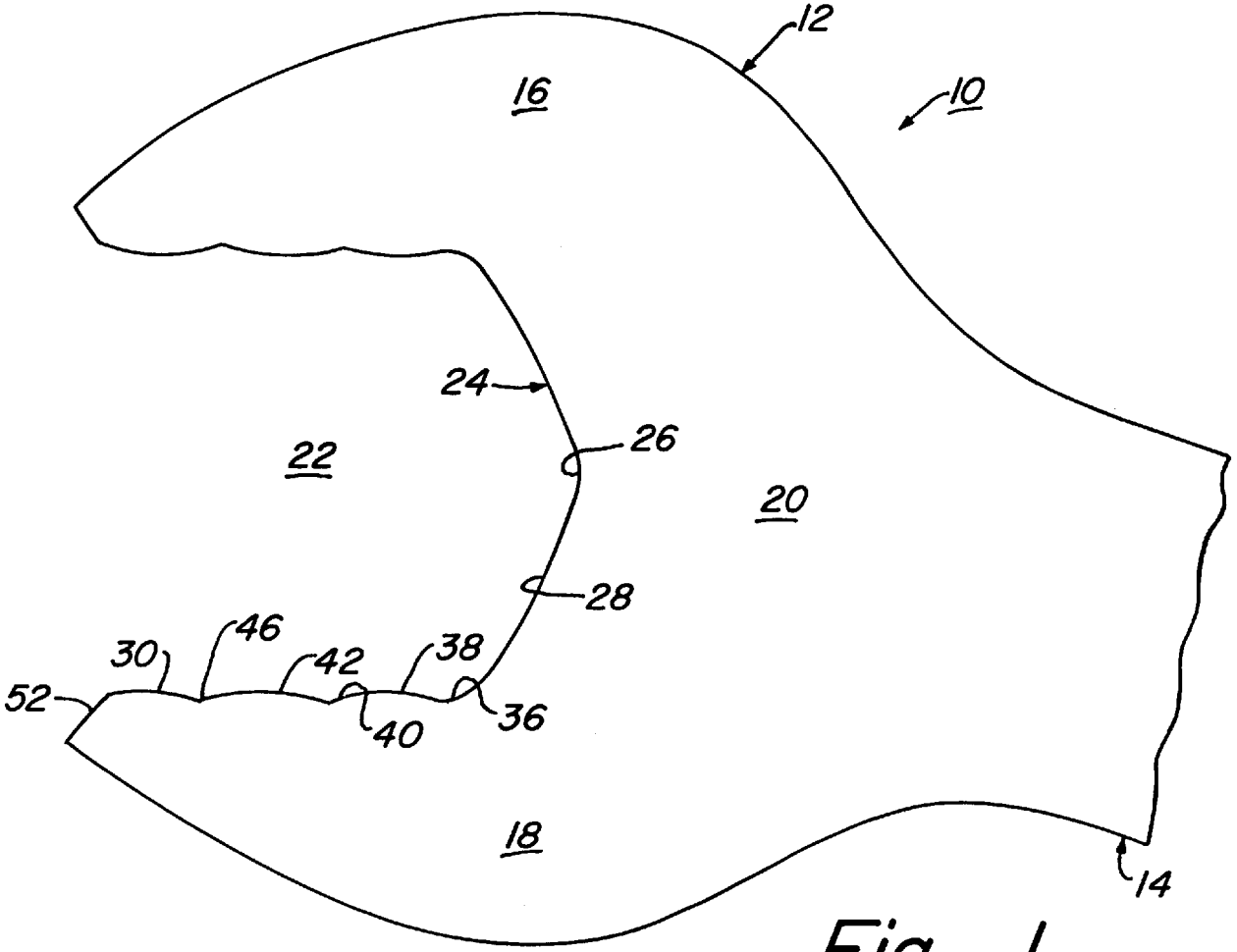
FIG. 1 is a top plan view of an open-end wrench constructed in accordance with the invention.
Figure 2:
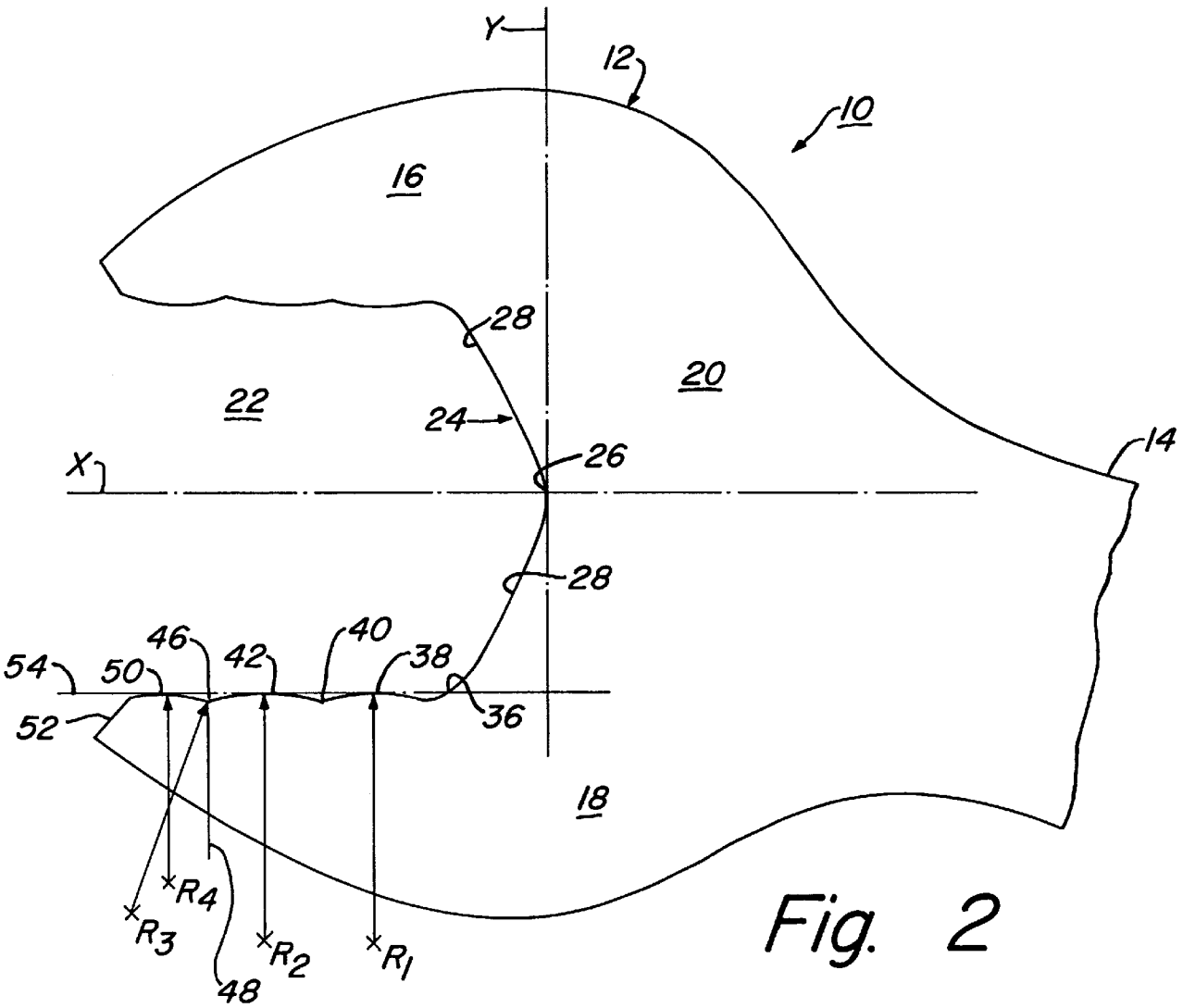
FIG. 2 is a top plan view of the wrench of FIG. 1, shown with further details of the jaw faces of the wrench.

FIG. 1 shows a wrench 10 having an open-end wrench head 12 joined to a handle 14. The wrench head 12 has fixed upper and lower jaws 16, 18. The jaws 16, 18 are spaced apart and rigidly joined together at their rearward ends by a web 20. The spaced jaws 16, 18 define a nut slot 22. As shown in FIG. 2, the wrench head 12 is bisected by a horizontal center line or axis X. Handle 14 is located on an angle 15 of about 15° relative to axis X.

Located at the very rearward end of the slot 22 of the wrench head 12 is a back stop 24. Back stop 24 is formed with a corner stop face 26. The corner stop face 26 is a concave surface having a radius of curvature of about 0.5565 inches or 0.278 X N, where N is the maximum width of the nut to be driven. Unless otherwise stated, specific dimensions given for the wrench head are for use with hexagonal nuts where the maximum nut size is two inches as measured from flat to flat. References to the nut and relative positions are also with respect to the maximum size nut. Such references and dimensions are given for ease of description and understanding purposes only and should in no way be construed as limitations. It should be readily apparent to those skilled in the art that these dimensions will vary from wrench to wrench depending on the size of the nut it is designed for. The curvature and shape of the faces described herein is substantially the same through any cross section of the wrench head 12 throughout its thickness. A vertical tangent line or axis Y (FIG. 2) passes through the apex of corner stop face 26 where it intersects the line X. Axis Y is perpendicular to axis X.

The radius of curvature for stop face 26 has its point of origin located on line X. Corner stop face 26 is bisected by the line X and merges on either side with a rear clearance face 28 of the jaws 18, 20. Clearance faces 28 of each jaw 16, 18 are concave surfaces having a radius of curvature of about 1.575 X N. Concave surfaces 28 are generally oriented so that tangent lines passing through the apex of each curved surface 28 are at an angle of about 120° to each other.

Figure 3:
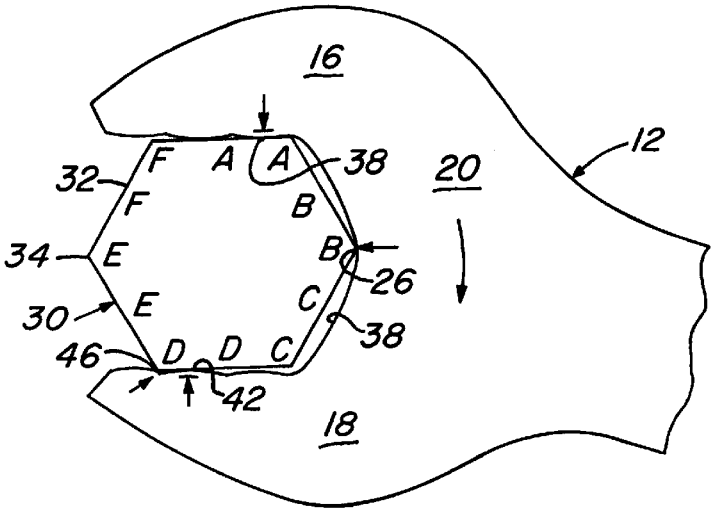
FIG. 3 is a top plan view of the wrench of FIG. 1, shown engaged with a nut in a primary drive position.

FIG. 3 shows the wrench head 12 engaged in a first or primary drive position with a nut 30. The nut 30 has six sides or flats 32 with adjacent flats intersecting at approximately 120° to form corners 34. The individual flats 32 and corners 34 of the nut 30 are each designated with an A, B, C, D, E or F for ease of description. As shown in FIG. 3, the concave surfaces 28 generally coextend along adjoining nut flats 32B and 32C of the nut 30, with the corner 34B abutting against the corner face 26, generally along the line X. The corner face 26 and concave surfaces 28 may vary and be a continuous single radius curve, or even straight lines so long as the corner face 26 is located along the line X so that the corner face 26 acts as a positioning surface when the nut 30 is in the first drive position and the other surfaces 28 provide a clearance for the nut.

Referring again to FIG. 2, each clearance face 28 merges at the opposite end with a concave fillet 36. Each fillet 36 has a radius of curvature of about 0.188 X N. The fillets 36 of jaws 16, 18 provide a clearance for the corners 34A, 34C, respectively, when in the first drive position. Each fillet 36 merges into a rearward drive face 38. It should be understood that the jaw surfaces of each of the jaws 16, 18 are identical mirror images of each other on either side of the bisecting line X. Thus, for ease of description purposes, unless otherwise stated, the description applied to the lower jaw 18 should be understood as applying to the upper jaw 16 as well. Also, the words "upper" and "lower" are used arbitrarily.

Each rearward drive face 38 is a convex arcuate surface having a radius of curvature $R_1$ of 1.6250 inches or 0.8125 X N. The rearward drive face 38 begins at a point located approximately 0.7365 inches or 0.3683 X N from the vertical axis Y and terminates at a position 1.0380 inches or 0.519 X N from Y. The radius of curvature $R_1$ has a point of origin located 2.5° forward from a vertical line extended from the forward end of the rearward drive face 38. A rearward notch 40 adjoins the forward end of the rearward drive face 38. The rearward notch 40 is a flat surface that slopes downward from the drive face 38 at an angle of about 17.5° and terminates at a position 1.049 inches or 0.5245 X N from the Y axis.

Adjoining the forward end of each rearward notch 40 is a intermediate drive face 42. Each drive face 42 extends from the notch 40 for a distance of about 1.6025 inches or 0.8012 X N from the Y axis. Each drive face 42 is a convex arcuate surface having a radius of curvature $R_2$ of about 1.6250 inches or 0.8125 X N. The point of origin for the radius $R_2$ is located along a vertical line located 1.342 inches or 0.671 X N from the Y axis. The apex of the drive face 42 is also located along this line.

Adjoined to the forward end of each intermediate drive face 42 is a forward notch 46. Each forward notch 46 is a convex arcuate surface having a radius of curvature $R_3$ of about 1.75 inches or 0.875 X N. Each forward notch 46 terminates at its forward end at a position 1.7575 inches or 0.8879 X N from the Y axis. Forward notch 46 is positioned to generally coincide with nut corner 34D which is approximately 0.86 X N from the Y axis. The point of origin for the radius $R_3$ is located 8° forward from a vertical line 48 extended from the forward end of the forward notch 46. The forward end of each intermediate drive face 42 forms a forward-facing intermediate catch face when the wrench head 12 is in the forward drive position shown in FIG. 5.

Forward drive face 50 adjoins the forward end of the notch 46. Drive face 50 is a convex arcuate surface having a radius of curvature $R_4$ of about 1.75 inches or 0.875 X N. The point of origin for radius $R_4$ is located on the vertical line 48, which also coincides with the apex of the drive face 50. Drive face 50 terminates at a distance of about 2.11 inches or 1.055 X N from the Y axis.

An end face 52 extends from the forward end of each drive face 50. The end face 52 is a flat surface that slopes downward from the drive face 50 at an angle of about 45° from the X axis.

Referring to FIG. 2, each of the drive surfaces 38, 42 and 50 has an apex or uppermost point located along a tangent line 54 which is parallel to axis X. This line 54 is spaced above the lowermost point of the notches or junctions 43, 47 a distance of about 0.0280 inches or 0.014 X N. The vertical distance from the line 54 to the apices of the drive faces of the upper jaw 16 is 2.010 inches.

In operation, the wrench 10 can be used in three different drive positions. In a rearward or first drive position, the nut 30 is slid rearward into the slot 22 so that corner 34B contacts corner stop face 26 of the backstop 24, thus preventing further rearward movement. In the primary drive position, the rear faces 28 do not contact the nut 30. The wrench head 12 naturally assumes the first drive position when the wrench head 12 is rotated, as shown in FIG. 3. For illustrative purposes, only clockwise rotation is shown in relation to the nut 30. The engagement of the jaw faces of jaws 16, 18 would be just the opposite for reverse or counter clockwise rotation.

In the first drive position, the forward portion of intermediate drive face 42 of lower jaw 18 contacts the forward portion of nut flat 32D and rear drive face 38 of upper jaw 16 contacts the rearward portion of nut flat 32A. When the wrench 10 is under torque in the first drive position, the wrench head 12 is locked onto the nut 30 to prevent both forward and rearward movement of the wrench. Forward movement of the wrench head 12 is prevented by engagement of the nut 30 with the corner stop 26, and rearward movement of the wrench head 12 is prevented by engagement of the nut corner 34D with forward notch 46. Due to allowed manufacturing tolerances in both the nut and wrench, there will be some slight relative forward or rearward movement of the nut and wrench between corner stop 26 and forward notch 46. This allows the wrench to be used at an angle of approach to the nut while still locking the wrench on the nut when in the first drive position. Torque is applied to the nut 30 along the flats 32A, 32D through rearward drive face 38 and intermediate drive face 42 of upper and Lower jaws 16, 18, respectively.

Figure 4:
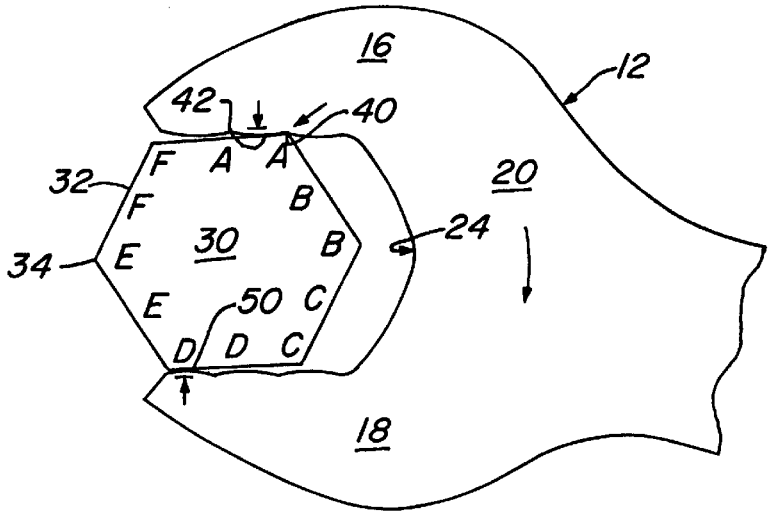
FIG. 4 is another top plan view of the wrench of FIG. 1, shown engaged with a nut in an intermediate drive position.

Referring to FIG. 4, the wrench 10 is shown engaged with the nut 30 in an intermediate or second drive position. In the intermediate drive position, the nut 30 is spaced slightly forward from the backstop 24. The rearward portion of intermediate drive face 42 of the upper jaw 16 contacts the rearward end of nut flat 32A. The forward drive face 50 contacts the forward portion of nut flat 32D. Under clockwise torque, forward movement of the wrench 10 is prevented by engagement of the nut corner 34A with the rearward notch 40 of the upper jaw 16 so that the wrench head 12 does not slip from the intermediate drive position.

Figure 5:
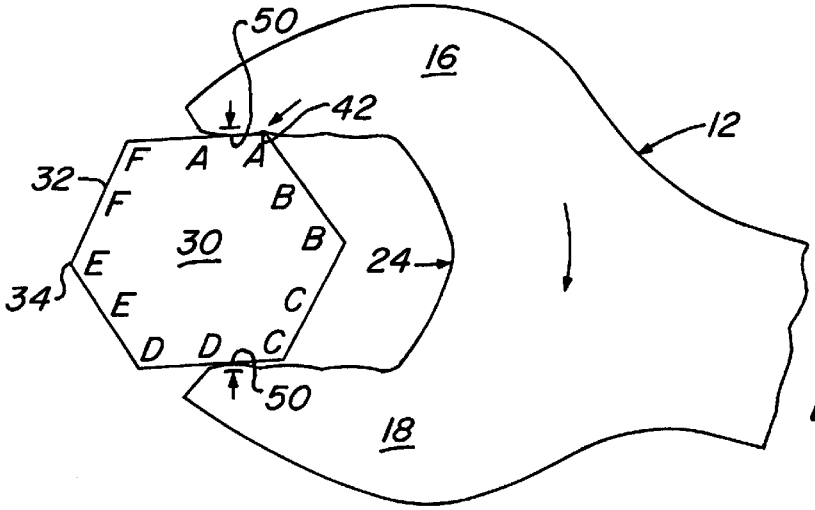
FIG. 5 is a top plan view of the wrench of FIG. 1, shown engaged with a nut in a forward drive position.

FIG. 5 shows the wrench 10 engaged with the nut 30 in a forward or third drive position. In the third drive position, the nut 30 is spaced even further from the backstop 24. Torque is applied through the directly opposing forward drive faces 50 of the upper and lower jaws 16, 18. During clockwise torque, the forward drive face 50 of the upper jaw 16 contacts the nut flat 32A, and the forward drive face 50 of the lower jaw 18 contacts the nut flat 32D. Forward movement of the wrench 10 is prevented by contact of the nut corner 34A with the forward end of the intermediate drive face 42 of upper jaw 16 at the junction 47. This facilitates maintaining the wrench head 12 in the forward drive position.

There are several significant advantages to this invention. Due to the arcuate drive surfaces of the wrench 10, torque is applied to the nut flats and not the corners in all three drive positions. This prevents rounding off of the corners as occurs with conventional flat-jaw-faced wrenches. The arcuate drive surfaces are of sufficient radius so as to guarantee a large footprint where the drive surface contacts the flat of the nut to prevent nut damage as occurs with other wrenches having either short radius arcuate drive surfaces or sharp points of contact to the flats of the nut. The notches help to maintain the wrench head in position on the nut when torque is applied. This prevents the wrench from slipping off the nut or into one of the other drive positions when torque is being applied. The wrench head has three distinct drive positions allowing a nut to be driven with the wrench fully seated on the nut, with the wrench intermediately seated on the nut, or with the wrench tips. The intermediate and forward drive positions permit a nut to be driven more quickly because the wrench does not have to be fully seated before each stroke. Further, this invention can be used in situations where space constraints do not allow the wrench to seat fully on the nut. The head of this invention can be smaller than other wrenches with arcuate drive surfaces, thus saving on the cost of the manufacturing blank. The smaller head also allows the wrench to be used in situations where the head of other wrenches may be too large.

While the invention has been shown in only one of its forms, it should be apparent to those skilled in the art that it is not so limited, but is susceptible to various changes without departing from the scope of the invention.

I claim:

1. A wrench having a fixed head for use with a hexagonal nut, the head comprising:

an upper jaw having an upper forward drive face, an upper intermediate drive face, and an upper rearward drive face, the upper forward, upper intermediate, and upper rearward drive faces facing generally downward;

an upper forward notch separating the upper forward drive face and upper intermediate drive face;

an upper rearward notch separating the upper intermediate drive face and the upper rearward drive face;

a lower jaw which is a mirror image of the upper jaw, having a lower forward drive face, a lower intermediate drive face, and a lower rearward drive face separated by notches; and a back stop face joining the upper and lower rearward drive faces;

wherein the forward, intermediate, and rearward drive faces enable the wrench to drive a nut in three different positions.

2. The wrench of claim 1 wherein all of the drive faces are convex and arcuate.

3. The wrench of claim 1 wherein a shortest distance between the upper forward drive face and the lower forward drive face is substantially the same as a shortest distance between the upper rearward drive face and the lower rearward drive face.

4. The wrench of claim 1 wherein a distance between the upper forward drive face and the lower forward drive face is adapted to be slightly greater than a diameter of the nut measured from a first side to an opposite side, the distance being measured perpendicular to a line bisecting the head equidistant between the upper forward drive face and the lower drive face.

5. The wrench of claim 1 wherein the forward and rearward drive faces are curved, each having a mid point, a tangent line to both of the mid points being located on a line parallel to a line bisecting the head.

6. The wrench of claim 1 wherein the intermediate drive face is curved, having a mid point, a tangent line to the mid points of the forward and intermediate drive faces being located on a line parallel to a line bisecting the head.

7. The wrench of claim 1 wherein a distance along a line bisecting the head measured from the backstop face to the upper forward notch is substantially 86% of a distance between the upper forward drive face and the lower forward drive face.

8. A wrench for use with a hexagonal nut, comprising:

an upper jaw spaced apart from a lower jaw, the upper jaw terminating in an end face and being rigidly formed with the lower jaw such that the jaws are immovable relative to each other;

an arcuate upper forward drive face located on the upper jaw adjacent to the end face and generally facing the lower jaw;

an arcuate upper intermediate drive face located on the upper jaw adjacent to and rearward of the upper forward drive face and generally facing the lower jaw;

an upper forward notch between the upper forward drive face and the upper intermediate drive face;

an arcuate upper rearward drive face located on the upper jaw adjacent to and rearward of the upper intermediate drive face and generally facing the lower jaw;

an upper rearward notch between the upper intermediate drive face and the upper rearward drive face;

the lower jaw being substantially a mirror image of the upper jaw having a lower forward drive face, a lower intermediate drive face, a lower rearward drive face, and lower forward and rearward notches; and a backstop face joining the upper rearward drive face and the lower rearward drive face;

the upper and lower forward notches being located at a distance from the back stop face, measured along a line bisecting the jaws, which is substantially 86% of a distance between the upper and lower forward drive faces, a distance between the upper and lower intermediate drive faces, and a distance between the upper and lower rearward drive faces;

wherein, the upper rearward drive face is adapted to engage a first side of a nut, the lower intermediate drive face is adapted to engage an opposed second side of the nut, the lower forward notch is adapted to engage a nut corner adjacent to the second side, and the back stop face is adapted to engage a corner of the nut when the wrench is in a primary drive position;

the upper intermediate drive face is adapted to engage the first side of the nut, the upper rearward notch is adapted to engage a nut corner adjacent to the first side, and the lower forward drive face is adapted to engage the second side of the nut when the wrench is in a intermediate drive position; and the upper forward drive face is adapted to engage the first side of the nut, the upper forward notch is adapted to engage a nut corner adjacent to the first side, and the lower forward drive face is adapted to engage the second side of the nut when the wrench is in a forward drive position.

* * * * *